US011136231B2

(12) United States Patent
Schoenfelder

(10) Patent No.: US 11,136,231 B2
(45) Date of Patent: Oct. 5, 2021

(54) DEVICE FOR TREATING CONTAINERS, AND BEVERAGE FILLING SYSTEM

(71) Applicant: KRONES AG, Neutraubling (DE)

(72) Inventor: Markus Schoenfelder, Neutraubling (DE)

(73) Assignee: KRONES AG, Neutraubling (DE)

( * ) Notice: Subject to any disclaimer, the term of this patent is extended or adjusted under 35 U.S.C. 154(b) by 0 days.

(21) Appl. No.: 15/579,737

(22) PCT Filed: Apr. 7, 2017

(86) PCT No.: PCT/EP2017/058363
§ 371 (c)(1),
(2) Date: Mar. 5, 2018

(87) PCT Pub. No.: WO2017/174772
PCT Pub. Date: Oct. 12, 2017

(65) Prior Publication Data

US 2019/0071296 A1 Mar. 7, 2019

(30) Foreign Application Priority Data

Apr. 7, 2016 (DE) ..... 10 2016 106 378.9

(51) Int. Cl.
*B67B 3/20* (2006.01)
*B67C 7/00* (2006.01)

(52) U.S. Cl.
CPC ..... *B67C 7/004* (2013.01); *B67B 3/2013* (2013.01)

(58) Field of Classification Search
CPC ..... B67C 7/004; B67B 3/2013
(Continued)

(56) References Cited

U.S. PATENT DOCUMENTS 4,939,890 A * 7/1990 Peronek ..... B67B 3/2033 53/289
5,934,042 A * 8/1999 Peronek ..... B67B 3/2033 53/317

(Continued)

FOREIGN PATENT DOCUMENTS

CN 101309844 11/2008
CN 101723293 6/2010

(Continued)

OTHER PUBLICATIONS

Office Action in related Chinese Patent Application No. 201780001926.4, dated Mar. 12, 2019, 9 pages.

*Primary Examiner* — Anna K Kinsaul
*Assistant Examiner* — Chinyere J Rushing-Tucker
(74) *Attorney, Agent, or Firm* — Haynes and Boone, LLP

(57) ABSTRACT

A device for treating at least one container, for example a beverage filling system for filling and/or closing a container is described. The device includes a treatment carousel rotating about an axis of rotation with at least one treatment unit, arranged in the peripheral region of the treatment carousel, for treating the container that is to be treated, and a container holder arranged on the treatment carousel and assigned to the treatment unit, for holding the container during treatment with the treatment unit. A container transfer receptacle which is assigned to the container holder and is radially displaceable with respect to the axis of rotation is provided for receiving the container to be treated from an upstream treatment carousel and/or for transferring the now treated container to a downstream treatment carousel.

19 Claims, 5 Drawing Sheets

(58) Field of Classification Search
USPC ..... 53/284.5
See application file for complete search history.

(56) References Cited

U.S. PATENT DOCUMENTS

| | | | | |
|---|---|---|---|---|
| 2005/0172580 | A1* | 8/2005 | Krulitsch | B67C 3/004 53/471 |
| 2009/0250314 | A1 | 10/2009 | Zanini et al. | |
| 2010/0077703 | A1* | 4/2010 | Gourlaouen | B65G 47/847 53/473 |
| 2010/0294622 | A1* | 11/2010 | Graffin | B67C 7/004 198/470.1 |
| 2012/0260955 | A1* | 10/2012 | Winzinger | B29C 49/4205 134/43 |
| 2014/0318079 | A1* | 10/2014 | Gruson | B65G 47/52 53/266.1 |
| 2015/0315002 | A1* | 11/2015 | Handler | B67B 3/2026 53/490 |
| 2017/0327365 | A1* | 11/2017 | Pagliarini | B67C 7/0073 |

FOREIGN PATENT DOCUMENTS

| | | |
|---|---|---|
| CN | 102171115 | 8/2011 |
| CN | 102428015 | 4/2012 |
| CN | 103459277 | 12/2013 |
| EP | 1277693 | 1/2003 |
| EP | 2179960 | 4/2010 |
| EP | 3199490 | 8/2017 |
| WO | WO 2014/173557 | 10/2014 |

* cited by examiner

DEVICE FOR TREATING CONTAINERS, AND BEVERAGE FILLING SYSTEM

CROSS REFERENCE TO RELATED APPLICATIONS

This application is a national stage of International Application No. PCT/EP2017/058363, filed Apr. 7, 2017, which claims priority from German Patent Application No. 10 2016 106 378.9 filed on Apr. 7, 2016 in the German Patent and Trademark Office, the disclosures of which are incorporated herein by reference in their entirety.

BACKGROUND

Technical Field

The invention relates to a device for treating containers, for example for filling or closing containers in a beverage filling system, and a beverage filling system with such a device.

Related Art

In beverage filling systems with a conventional sequence of successive carousels for treating containers, the containers to be treated are transported, usually by means of transport starwheels, between the carousels in which the containers undergo treatment. The containers to be filled are, for example, filled with the applicable filling product in a rotary filler in a filler carousel, and the filled containers are then capped in a downstream rotary capper in a capper carousel. The transfer of the filled containers between the filler carousel and the capper carousel takes place by means of one or more transport starwheels, with the result that the use of materials and resources is increased, as are the required floor space and the investment costs.

In high-performance systems, the filling product may spill out when the containers are transferred from a filler carousel to a filler outfeed starwheel, and/or when they are transferred from a transport starwheel to a capper carousel. This may be due to the load changes affecting the container and the filling product contained within it, or the abrupt change in the centrifugal forces acting on the filling product. This undesirable behavior occurs in particular in the case of transport starwheels with diameters that are smaller than the diameters of the filler carousel and the capper carousel, due to the wish for a compact system.

The interposition of transfer starwheels also subjects the containers to additional changes in direction, and transfers between different carousels along the container path, which accordingly lead at each change of direction and every transfer to a change in the direction of the forces that act on the filling product, and thereby to a tendency to slosh over. The changes of direction and the transfers can also lead to increased material stresses, which can manifest themselves in undesirable scratches or tarnished areas on the fully treated container.

SUMMARY

An improved device for treating containers is described.

Accordingly, a device for treating at least one container, for example a beverage filling system for filling and/or closing a container, is described. The device includes a treatment carousel rotating about an axis of rotation with at least one treatment unit, arranged in the peripheral region of the carousel, for treating the container that is to be treated, and a container holder arranged on the treatment carousel and assigned to the treatment unit, for holding the container during the treatment with the treatment unit. A container transfer receptacle which is assigned to the container holder and is radially displaceable with respect to the axis of rotation is provided for receiving the container to be treated from an upstream treatment carousel and/or for transferring the now treated container to a downstream treatment carousel.

Due to the fact that a container transfer receptacle which is assigned to the container holder, for receiving and/or transferring the container to be treated, is disposed on the carousel such that is radially displaceable with respect to an axis of rotation of the carousel, a container that is held by a container holder of an upstream treatment carousel can be removed by the container transfer receptacle from its container holder, and transferred directly to the container holder to which the container transfer receptacle is assigned. The container transfer receptacle can also remove the applicable container from this container holder and then transfer it to a downstream treatment carousel. It is accordingly possible to dispense with an additional transfer device between the treatment carousels, for example in the form of a transfer starwheel. It is thereby possible to reduce the number of changes in direction that the filled but not yet closed container must undergo, so that the tendency to slosh over can be decreased. It is further possible to reduce the number of transfers of the container between the different transport devices, which can be reflected in reduced material stresses on the container and hence in an improvement in the quality of the container. In particular, it is possible to reduce the occurrence of tarnished areas and scratches on the container walls of the fully treated containers.

Furthermore, because the interposition of transfer starwheels is dispensed with, the system as a whole can be designed to be more compact, more cost-effective and more energy efficient.

Due to the direct transfer between the treatment carousels, the handover or receipt takes place directly between the treatment carousels, which define the minimum required diameter according to the performance for which they are designed. Accordingly, by means of the direct transfer between the two treatment carousels, the centrifugal forces that arise can be reduced to the maximum level that is defined by the performance of the system.

Due to the fact that the container transfer receptacle is disposed on the treatment carousel such that it is radially displaceable, it can be displaced from the position beneath the treatment unit, so that an orbit, i.e. a radius, in which the container held by the container transfer receptacle moves, can be changed by displacing the container transfer receptacle. By this means, abrupt and/or jolting changes in the movement of the container during container transport can be avoided or moderated. As a result, it is possible to eliminate or reduce the risk of sloshing over, with the associated contamination of the opening of the container and/or the exterior of the container, along with the contamination of the device and/or parts of the system that include the device.

Because the container transfer receptacle is radially displaceable, it can further be achieved, by appropriate control of the radial position, that collisions between the treatment units of the treatment carousels during takeover or handover of the container to be treated are avoided. The two treatment carousels can accordingly be spaced apart from each other, and the takeover or handover is carried out by means of the container transfer receptacle.

Furthermore, by means of this arrangement the system can be designed to be more compact, since it is possible to dispense with a transport starwheel for transferring the container from the treatment carousel, from which the container to be treated is removed, or to the treatment carousel, to which the treated container is transferred. By this means it is also achieved that the container can be displaced in a simple manner into the correct position beneath the treatment unit for treatment by the treatment unit. In particular, gentle transfer of the containers that are to be treated or have been treated can be achieved.

By means of the radial extension of the container transfer receptacle, there is an increase in the radius with which the container transfer receptacle rotates about the axis of rotation of the applicable treatment carousel, so that the centrifugal forces that act on the container in this rotation angle range of the treatment carousel are reduced, and a correspondingly gentle transfer of the container can thereby be achieved.

The container to be treated can thus be received by the container transfer receptacle at a position radially outside the normal pitch circle of the treatment carousel, and the container transfer receptacle can then be retracted radially to the pitch circle of the treatment carousel. When treatment is completed, the newly treated container can be transferred to a subsequent transport device, for example with the aid of renewed radial extension of the container transfer receptacle to a position radially outside the pitch circle of the treatment carousel.

It is thereby possible to dispense with an interposed transport starwheel, in particular also when a further treatment carousel, which receives the containers to be treated or to which the treated containers are transferred, has a pitch circle with a diameter differing from the pitch circle diameter of the first treatment carousel. By this means the system as a whole can be designed to be more compact. In addition, the transfer of the containers takes place in a gentle manner, since, with the aid of the displaceable container transfer receptacle, a greater radius can be created at the point of transfer of the containers. The radii of the two applicable pitch circles are thereby adapted to each other. Thus the treatment carousel can for example have a relatively small pitch circle diameter, while at the same time a greater radius can be provided at the time of transfer, and radial accelerations acting on the container can be reduced. If the device is one that receives open containers, for example if the treatment unit is designed as a capping head, the risk of sloshing over can thereby be reduced, and at the same time a compact system can be provided.

It is further possible by this means to provide, by comparison with a normal pitch circle diameter of the treatment carousel, a greater radius, which is virtually linear in effect. In this transfer region, the container can undergo an intermediate treatment, for example the dropwise introduction of nitrogen into the head space of the filled container before it is closed.

The transfer by means of the device of each of the containers from an upstream treatment carousel, via the treatment carousel, to a downstream treatment carousel, can accordingly be achieved as a transfer between three successive treatment carousels. In these treatment carousels, highly diverse possible treatments can be provided, which the container to be treated thus undergoes successively.

The applicable treatment carousels can for example provide at least one of the following possible treatments: pivoting, rotating, labelling, shrinking, blowing, stretch blow-molding, opening, dome cutting, cleaning, sterilizing, activating, rinsing (gaseous and/or fluid), flush-off showering, warming, heating, cooling, blowing out, flame treatment, elimination of electrostatic charges, pre-filling, final filling, pre-closing with a pre-closure, closing, attachment of a first closing part and/or attachment of a second closing part.

The container transfer receptacle can in various embodiments be displaced to a radially extended position for reception of the container to be treated from the upstream treatment carousel, and can be displaced to a radially retracted position for the transfer of the container to be treated to the container holder. In this manner a direct transfer of the containers from an upstream treatment carousel can be achieved. In such an arrangement, the container transfer receptacle is typically disposed on a rotary capper.

The container transfer receptacle can in certain embodiments be displaced from a radially retracted position such that the treated container can be transferred from the container holder to the container transfer receptacle, and the container transfer receptacle can be displaced to a radially extended position to transfer the treated container to the downstream treatment carousel. In such an arrangement, the container transfer receptacle is typically disposed on a rotary filler.

In one embodiment, the container that is held by the container transfer receptacle is transferred from the container transfer receptacle to the container holder in the radially retracted position of the container transfer receptacle. The container transfer receptacle is thereby provided only for the transfer of the container to or from the container holder. Any forces that may act on the container during the treatment by the treatment unit are thus absorbed by the container holder. The container transfer unit can have a correspondingly simple design, since it must only hold the container during the transfer, and is not required to support the forces arising during treatment.

In another embodiment, the container transfer receptacle is disposed above the container holder or below the container holder, viewed in the direction of the axis of rotation. By this means each of the two container holders can receive or hold the container at the same point. In this case, the container holder of the treatment carousel and the container holder of the upstream or downstream treatment carousel are generally disposed at the same height, so that no additional forces act on the container due to a lifting or lowering movement, and the tendency to slosh over can thereby be further reduced.

It is particularly advantageous for the container transfer receptacle to be designed such that the container is supported on the container holder of the treatment carousel and/or the container holder of the upstream or downstream treatment carousel by means of a protuberance, typically annular and generally in the form of a security ring, on a container neck of the container. By this means it can be ensured that the container is always in an intended or predetermined position with respect to its height, in other words its position with respect to the direction of the axis of rotation.

In several embodiments, the container holder can be disposed on the treatment carousel such that the height of the container to be treated is the same as the height at which the container to be treated was disposed before the transfer to the container transfer receptacle. The term "height" is to be understood here as the distance of the container from a level floor upon which a system including the device is disposed. By this means, it can be achieved that the container to be treated is at all times in a correct treatment position.

In some embodiments, the container transfer receptacle has securing means, for example spikes, an indentation and/or a friction-enhancing material, to provide security against slipping when the container is held. By this means a container can be held securely despite the forces that arise during transfer. The spikes can also prevent the container from slipping out due to the centrifugal forces that arise. The securing means come into contact with, or engage, for example a support ring of the container.

Alternatively, other means can be provided for securing against slipping and/or rotation, for example in the form of a gripping or clamping device.

In various embodiments, the container transfer receptacle has at least one raised element for at least partially supporting the container, wherein generally at least one recess for accommodating the raised element is provided. Due to the fact that the container transfer receptacle has the at least one raised element, on which the container that is to be treated, or has been treated, is partially supported, it is possible to prevent the container that is to be treated, or has been treated, from slipping downwards during takeover or handover. In other words, the container can be conveyed at a constant height, without lifting or lowering movements, and in particular without unintended or uncontrolled lifting or lowering movements. It can further be ensured that the area of the container which is provided for the container holder to hold the container remains free.

A further advantageous design results if the container holder has a recess for accommodating the at least one raised element. By this means it can be ensured that the container is in the correct orientation, unhindered by the raised element, at all times until it is transferred to the container holder, and that it is transferred from the container transfer receptacle in this correct orientation.

In certain embodiments, the control guide has a non-rotatable cam curve, and the container transfer receptacle has a control element that engages with the control guide. By this means it is possible to provide automatic retraction and extension of the container transfer receptacle along the control curve, without separate electrical and/or pneumatic actuation. Furthermore, due to the fact that the control guide has a cam curve, it is possible to provide progressive and continuous changing of the radial position of the container transfer receptacle, without jolts or abrupt movements. Due to the rotation of the carrier, the container transfer receptacle adopts a radial position according to the shape of the cam curve, whereby the position of the container transfer receptacle is variable relative to the angle of rotation of the treatment carousel. The term "cam curve" is here to be understood as a curve with a round basic shape that has a different radius in at least one area, wherein the resultant curve has no sharp bends or corners along its course.

Alternatively, the displacement of the container transfer receptacle can be achieved by another means, for example hydraulically, pneumatically, by means of electrical actuators, and/or by an additional linkage and/or a mechanism including a piston and cylinder.

By means of the control element, the container transfer receptacle can follow the control guide exactly, without friction effects and/or clamping hindering the movement of the container transfer receptacle. The control element can generally be provided as a recess in which the control guide engages, or as a roller which is in contact with the control guide, and/or by means of a lever arm connected to the container transfer receptacle.

The control element is in various embodiments disposed in a region of the container transfer receptacle that lies radially inwards with respect to the axis of rotation of the treatment carousel, and hence opposite the region disposed radially outwards in which the container is held.

In one embodiment, the container transfer receptacle is also displaceable in the direction of the axis of rotation of the treatment carousel, i.e. in the upwards and/or downwards direction. By this means it is possible to adjust the height at which the container is held, i.e. the distance of the container from the floor on which the device is disposed, according to the requirements of the system. If there is a difference in height between the container holder and a transfer station from which the container transfer receptacle receives the container to be treated, this height difference can be overcome by the displacement of the container transfer receptacle in the direction of the axis of rotation, and the container to be filled can be transferred from the transfer station to the container holder. The container can also be delivered, if necessary directly, to the treatment unit while held by the container transfer receptacle, for example if the treatment unit is not displaceable in the direction of rotation of the treatment carousel.

In order, inter alia, to enable the container to be held particularly securely, the container transfer receptacle and/or the container holder can be switchable between an open position and a closed position for holding the container. The position of the container transfer receptacle and/or the container holder can typically be controlled by means of a control element, for example a switching cam.

In one embodiment, the treatment unit is provided as a capping head for closing the container, for example for closing the containers with a screw cap, or the treatment unit is provided as a filling element for filling the containers. By this means, it is possible to dispense with a transport starwheel which would otherwise need to be provided to transfer the containers to be closed, since the pitch circle diameter of a filling device needs to be considerably greater than the pitch circle diameter of the treatment carousel that includes the capping head. As a result, the system occupies less space, and the time spent in the system by a container is reduced.

A beverage filling system for filling containers with a filling product is described. The beverage filling system includes a filler carousel for filling containers that are to be filled and a capper carousel for closing filled containers, wherein the filler carousel and the capper carousel are spaced apart from each other, wherein the filler carousel has in its peripheral region treatment units in the form of filling elements with in each case their assigned container holders for holding the containers to be filled during filling, and wherein the capper carousel has in its peripheral region treatment units in the form of closing elements with in each case their assigned container holders for holding the filled containers during closing. In the peripheral region of the filler carousel and/or the capper carousel a container transfer receptacle is assigned to each container holder and is disposed such that it is radially displaceable with respect to the axis of rotation, for receiving the filled container from the filler carousel and/or for transferring the filled container to the capper carousel.

The advantageous effects described above also result in an analogous manner in the case of such a beverage filling system.

In particular, if the filler carousel and the capper carousel have differing pitch circle diameters, the handover or receipt of the containers between the treatment carousels can take place in a gentle manner, since with the aid of the radially displaceable container transfer receptacle a large radius can be provided at the transfer point. The radii of the two applicable pitch circles of the treatment carousels are thereby equalized at the time of handover or receipt.

It can thereby further be achieved that both the direct transfer and the treatment of the containers take place safely, without collisions occurring between parts of the two carousels. In the transfer position, the container transfer receptacle is in the radially extended position, and in the treatment position the container transfer receptacle is in the radially retracted position.

In particular when an intermediate treatment is provided on the filler carousel following the filling of the container, for example the dropwise introduction of nitrogen into the head space of the filled container, a further improved filling outcome can be achieved, since the distance that the container must travel between a nitrogen dosing unit for the dropwise introduction of the nitrogen and the capper head can be particularly short. With the same dosing quantity, less nitrogen vaporizes or escapes from the head space of the bottle if the distance traveled is shorter, so that a correspondingly higher pressure builds up in the interior of the container after it has been closed.

In one embodiment, a container holder of the capper carousel and a container holder of the filler carousel for accommodating the container are disposed at the same height. By this means it can be achieved that when the container is transferred from the first container holder to the second container holder it needs not undergo a change in height, which further reduces the risk of spillage of the filling product from the filled but not yet closed container.

If, in accordance with a further embodiment, the container is supported on the container holder of the filler carousel and/or the container holder of the capper carousel by means of a protuberance, for example annular and in some embodiments a container support ring or a security ring, disposed on the container neck, it can be ensured that the container is always in an intended or predetermined position with respect to its height, in other words its position with respect to the direction of the axis of rotation.

BRIEF DESCRIPTION OF THE FIGURES

Further embodiments of the invention are more fully explained by the description below of the figures.

DETAILED DESCRIPTION

Examples of embodiments are described below with the aid of the figures. In the figures, elements which are identical or similar, or have identical effects, are designated with identical reference signs. In order to avoid redundancy, repeated description of these elements is in part dispensed with.

Figure 1:
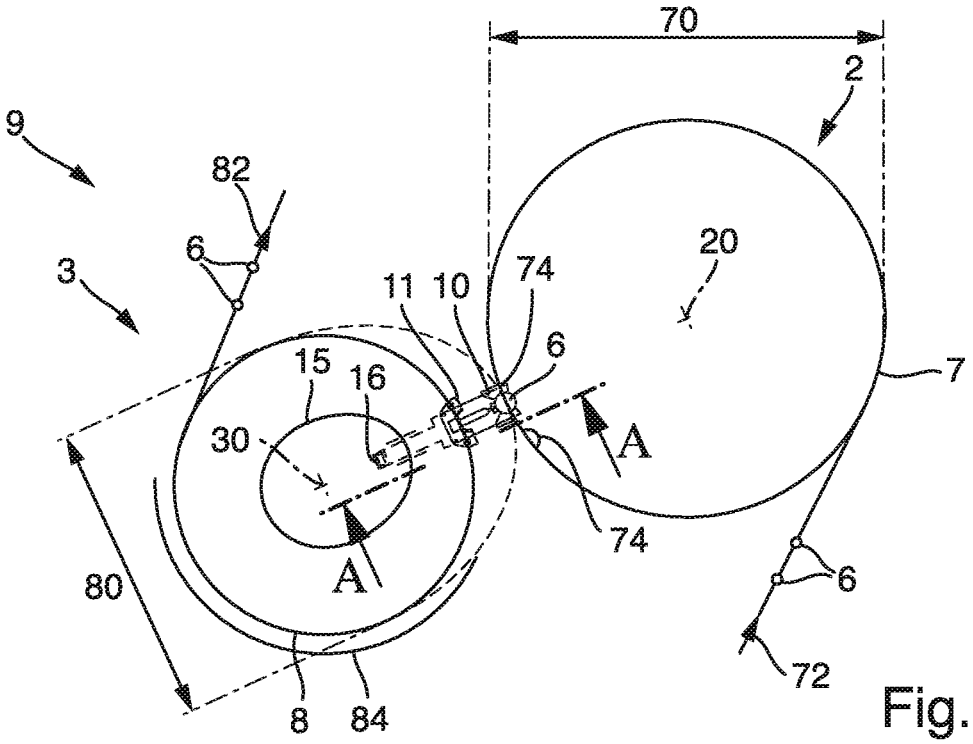
FIG. 1 is a schematic plan view of a beverage filling system for filling schematically represented containers that are to be filled with a filling product, wherein a rotary filler and a downstream rotary capper for subsequently closing the filled containers are provided, and a container transfer receptacle is shown in a radially extended position.

FIG. 1 shows schematically a plan view of a beverage filling system 9 for filling schematically represented containers 6, wherein a rotary filler 2 for filling the containers 6 that are to be filled with a filling product, and a downstream rotary capper 3 for subsequently closing the filled containers 6, are provided.

The rotary filler 2 has a treatment carousel in the form of a filler carousel 7 which rotates about an axis of rotation 20, and on whose peripheral region are disposed at least one container holder 74 for accommodating the containers 6 that are to be filled during the filling process, and, assigned to the container holder 74, at least one filling element (which is not shown in FIG. 1) for filling the containers 6 that are to be filled.

The rotary capper 3 has a treatment carousel in the form of a capper carousel 8 which rotates about an axis of rotation 30, and on whose peripheral region are disposed at least one container holder 11 for accommodating the filled containers 6 during the capping process, and, assigned to the container holder 11, at least one capping element (which is not shown in FIG. 1) for capping the filled containers 6 with a container closure.

The filler carousel 7 and the capper carousel 8 are spaced apart from each other, so that the filler pitch circle 70 of the filler carousel 7 and the capper pitch circle 80 of the capper carousel 8 neither intersect nor are tangent to each other. Viewed in the direction of transport of the containers 6, the filler carousel 7 is downstream of a container infeed 72, from which the containers 6 from an upstream station that are to be filled are transferred to the container holder of the filler carousel 7. The container infeed 72 can be provided, for example, in the form of a transfer starwheel or a conveyor belt.

In order to transfer the filled containers 6 from the filler carousel 7 to the capper carousel 8, a container transfer receptacle 10 is provided. In the example embodiment shown in the figures, the container transfer receptacle 10 is disposed on the capper carousel 8, in order to receive the filled containers 6 from the filler carousel 7. In further example embodiments, which are not shown, the container transfer receptacle 10 can be disposed on the filler carousel 7, and the filled containers 6 are transferred to the capper carousel 8. In further example embodiments, which are not shown, container transfer receptacles 10 can be disposed on both the filler carousel 7 and the capper carousel 8, and the transfer of the filled containers can take place by means of a handover from the container transfer receptacle 10 disposed on the filler carousel 7 to the container transfer receptacle 10 disposed on the capper carousel 8.

In this manner, it is possible to achieve a transfer of the container 6 between treatment carousels which provide differing possible treatments. In addition to the possible filling and capping treatments which have already been mentioned, the applicable treatment carousels can for example provide at least one of the following possible treatments: pivoting, rotating, labelling, shrinking, blowing, stretch blow-molding, opening, dome cutting, cleaning, sterilizing, activating, rinsing (gaseous and/or fluid), flush-off showering, warming, heating, cooling, blowing out, flame treatment, elimination of electrostatic charges, pre-filling, final filling, pre-closing with a pre-closure, attachment of a first closing part and/or attachment of a second closing part.

The container transfer receptacle 10 provided on the capper carousel 8 which is shown in the example embodiment can be displaced radially with respect to the axis of rotation 30, in order in each case to remove a filled container 6 from its container holder 74 on the filler carousel 7 and then transfer it to the container holder 11 on the capper carousel 8, in order to enable a subsequent capping process.

In the example embodiment that is shown, the radial position of the container transfer receptacle 10 is controlled by means of a control element 16 which is disposed on the container transfer receptacle 10, and which communicates with a control guide 15 that is non-rotatably disposed on the rotary capper 3. In this case the control guide 15 is designed in the form of a cam curve, so that the change in the radial position of the container transfer receptacle 10 can take place in a continuous manner, without abrupt movements. By this means it is possible to inhibit the slopping over of the filling product in the filled but not yet closed container 6.

In the position shown in FIG. 1, the container transfer receptacle 10 is in a radially extended position, in which it is tangent to, or intersects, the filler pitch circle 70, and can receive the filled container 6 from the filler carousel 7. Because the filler carousel 7 and the capper carousel 8 rotate in opposite directions, the container 6 that is to be transferred separates gently from the container holder 74 of the filler carousel 7 when it is transferred, and is received by the container transfer receptacle 10.

Figure 3:
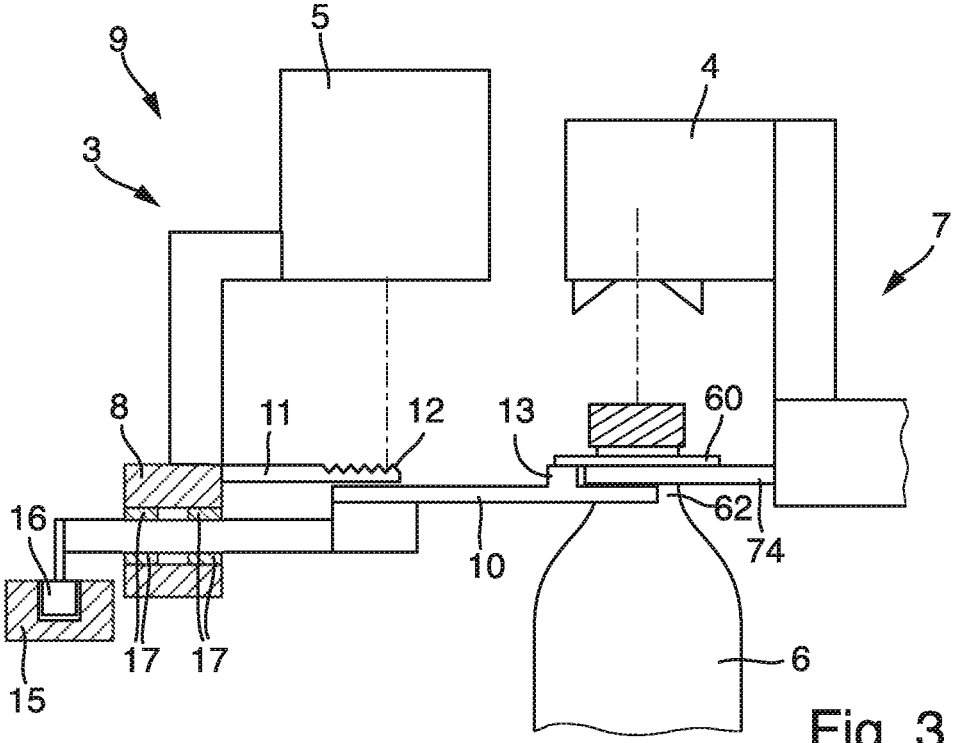
FIG. 3 is a schematic sectional view of a portion of the beverage filling system along the line of intersection A-A from FIG. 1.
Figure 4:
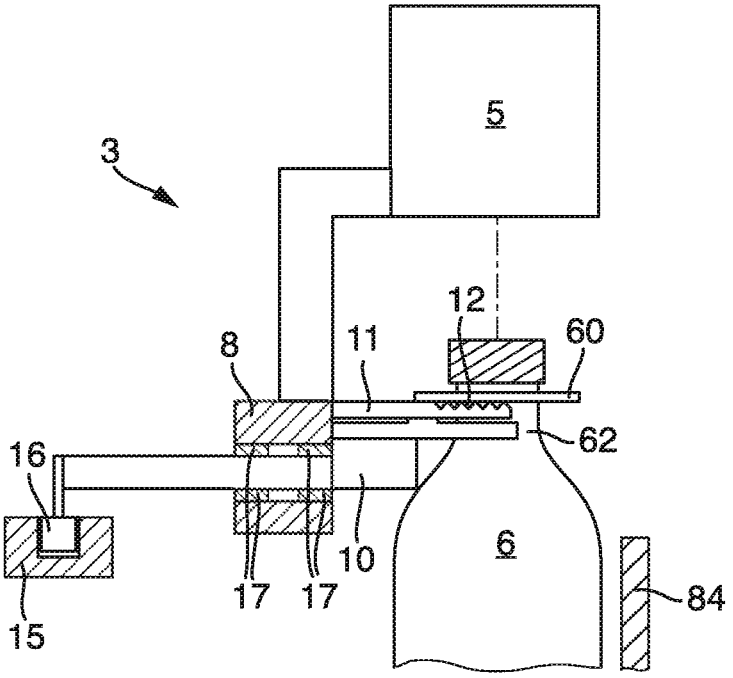
FIG. 4 is a schematic sectional view of a portion of the capper carousel along the line of intersection B-B from FIG. 2.

In order to guide the container transfer receptacle 10 in a radial direction with respect to the axis of rotation 30 of the capper carousel 8, a container transfer receptacle guide is provided in the form of a plain bearing 17 on the capper carousel 8, as shown for example in FIGS. 3 and 4. In addition, the container holder 11 is designed, and disposed on the capper carousel 8, such that the containers 6 that are to be closed can be received from the container transfer receptacle 10 when it is in a radially retracted position (see FIG. 4). By means of an outer guide 84, which is disposed outside and concentric with the capper carousel 8, the container 6 is pressed into the container holder 11 during the capping process, in order to prevent the container 6 from slipping or rotating, and in order to ensure that the central position of the container 6 relative to the capping head 5 that is arranged above it is maintained. Viewed in the direction of transport of the container 6, the treatment area of the capper carousel 8, which has the outer guide 84, is followed by a container outfeed 82. In the example embodiment that is shown, the container outfeed 82 is in a linear form. Alternatively, the container outfeed 82 can be provided in another form, for example as an additional treatment carousel for further treatment of the containers 6, for example for labelling the containers 6, or in the form of a transport starwheel.

Figure 2:
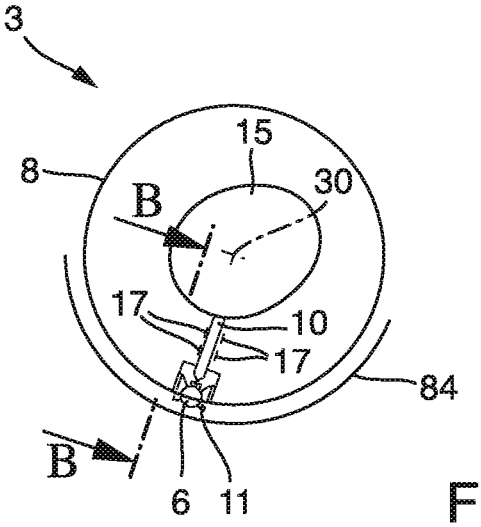
FIG. 2 is a schematic view of the rotary capper from FIG. 1, wherein the container transfer receptacle is in a radially retracted position.

FIG. 2 shows schematically the rotary capper 3 from FIG. 1, wherein the container transfer receptacle 10 is in a radially retracted position. Previously, following the transfer of the container 6 from the filler carousel 7, the container transfer receptacle 10 has been displaced via the control guide 15 into the radially retracted position, so that the container transfer receptacle 10 is now beneath the container holder 11, and the container 6 is held by container holder 11. The outer guide 84 presses the container 6 into the container holder 11, in order to prevent the container 6 from slipping or rotating, and in order to ensure that central position of the container 6 relative to the capping head (not shown here) that is disposed above it is maintained.

FIG. 3 shows schematically a sectional view of the beverage filling system 9 from FIG. 1 along the line of intersection A-A of FIG. 1, at the moment of transfer of the filled container 6 from the filler carousel 7 to the capper carousel 8. The filled container, which has been previously filled by means of the filling element 4 of the filler carousel 7, is still held in the container holder 74 of the filler carousel 7, wherein the container 6 is supported on the container holder 74 via a container support ring 60 disposed on the container neck 62.

In FIG. 3, the container transfer receptacle 10 of the capper carousel 8 is in the radially extended position, so that it is displaced radially outwards relative to the capping head 5 and the container holder 11 that is disposed concentrically beneath it. Because the container transfer receptacle 10 is in the radially extended position, it too grips the container 6 and holds it beneath the container holder 74. In order to prevent the container 6 from slipping downwards after it is transferred, and in order to enable it to be received at the same height, the container transfer receptacle 10 has a raised element 13, upon which the container support ring 60 is supported during and after transfer.

The container holder 74 of the filler carousel 7 and the container holder 11 of the capper carousel 8 are disposed at a common height, so that the container 6 undergoes no change in height as the container 6 is transferred from the container holder 74 to the container holder 11.

Because the container transfer receptacle 10 is disposed beneath the container holder 11, the container 6 is held by the container holders 74, 11 beneath the container support ring 60, at the same height position of the container neck 62 of the container 6, wherein the container 6 is supported in each case on the container holders 74, 11 by the container support ring 60—particularly also during the respective treatments, i.e. in particular during the filling in the filler carousel 7 and during the closing in the capper carousel 8. By this means the container 6 is transferred by means of the container transfer receptacle 10 directly from the rotary filler 2 to the rotary capper 3, and in each case during treatment the container 6 is held by the container holders 11 and 74 at the same height position of the container neck 62. The container holder 74 and the container holder 11 can thereby have particularly simple, and for example also identical, designs.

The container transfer receptacle 10 is positively guided via a control element 16 in the form of a roller which is guided in a groove of the control guide 15, and is kept in the radially extended position for the transfer of the container. Due to the fact that the control guide 15 is disposed beneath the capper carousel 8, it is possible to provide easy access to the capping head 5 and a simple design of the capper carousel 8. Alternatively, the control guide 15 can also be disposed radially within and/or above the container transfer receptacle 10 or the capper carousel 8.

FIG. 4 shows schematically a sectional view of the capper carousel 8 from FIG. 2 along the line of intersection B-B of FIG. 2. By means of the control guide 15, the container transfer receptacle 10 has been displaced to the radially retracted position, so that the container 6 is now positioned concentrically beneath the capping head 5 and held by the container holder 11. The container support ring 60 is thereby in contact with the spikes 12 disposed on the container holder 11, which prevent the container 6 from rotating or slipping during the capping process, and support it when a torque is applied to the container 6 as a container closure is screwed on or a roll-on closure is rolled on.

By means of the outer guide 84, the outer limit of the radial position of the container 6 with respect to the axis of rotation 30 of the treatment carousel 2 is secured, and the container 6 is pressed into the container holder 11.

Figure 5:
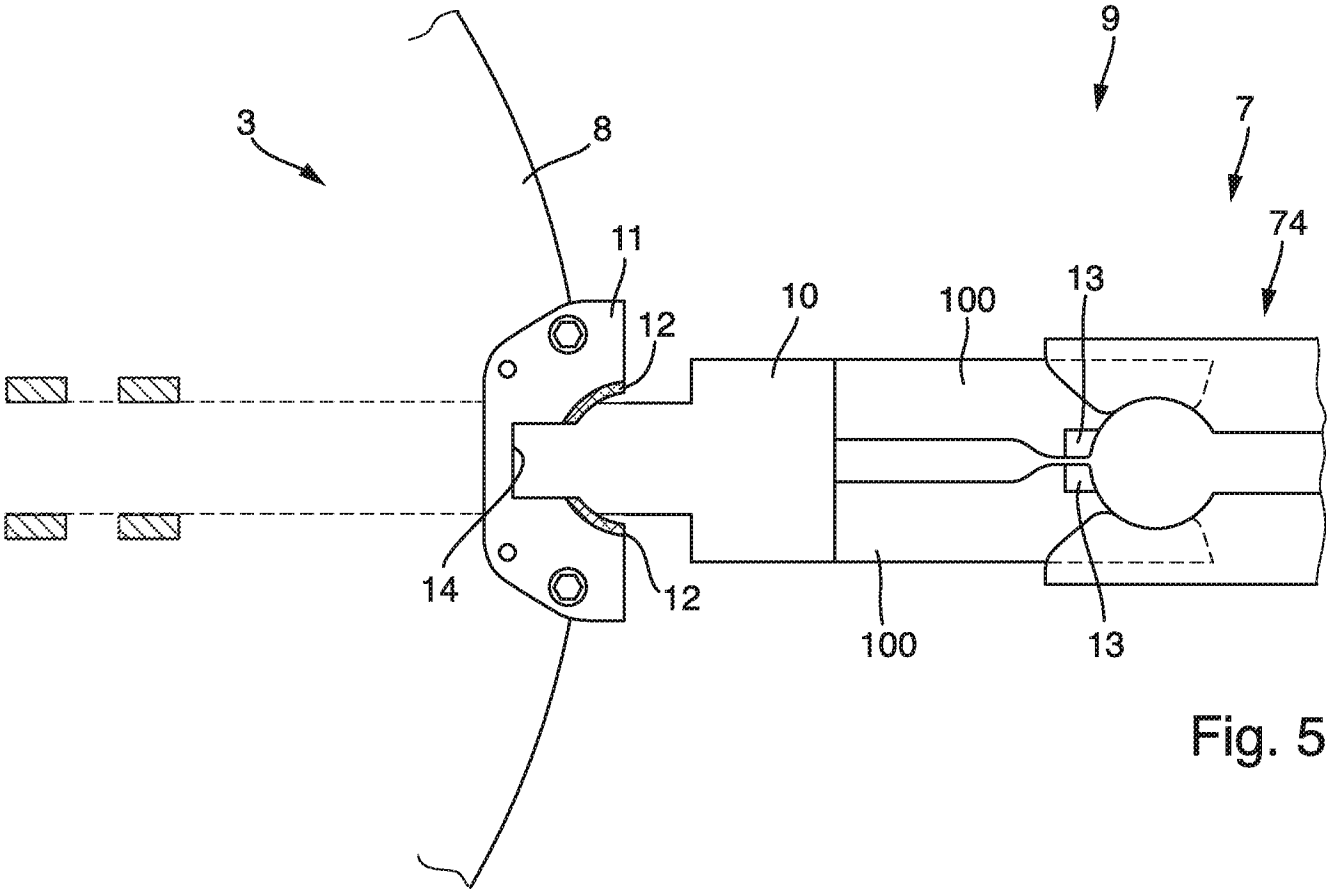
FIG. 5 is a schematic plan view of a portion of the beverage filling system according to FIG. 1, wherein the container transfer receptacle is in a radially extended position.

FIG. 5 shows schematically a plan view of a portion of the beverage filling system 9 according to FIG. 1, wherein the container transfer receptacle 10 is in a transfer position, i.e. in the radially extended position. This position corresponds substantially to the position of the container transfer receptacle 10 that is shown in FIG. 1 and FIG. 3.

The holding areas of the container transfer receptacle 10, which is disposed on the capper carousel 8, and the container holder 74, which is disposed on the filler carousel, in which the container (not shown here) is held, are in this case aligned with each other. Because the container transfer receptacle 10 is in the radially extended position, it is displaced radially outwards away from the container holder 11 disposed on the capper carousel 8. In order to hold the container, the container transfer receptacle 10 has clamping arms 100, each of which has a raised element 13. Alternatively, a raised element 13 can be disposed on only one of the clamping arms 100. The raised element 13 can also be provided in other forms, for example as a protuberance disposed centrally between the clamps on the container transfer receptacle 10.

Figure 6:
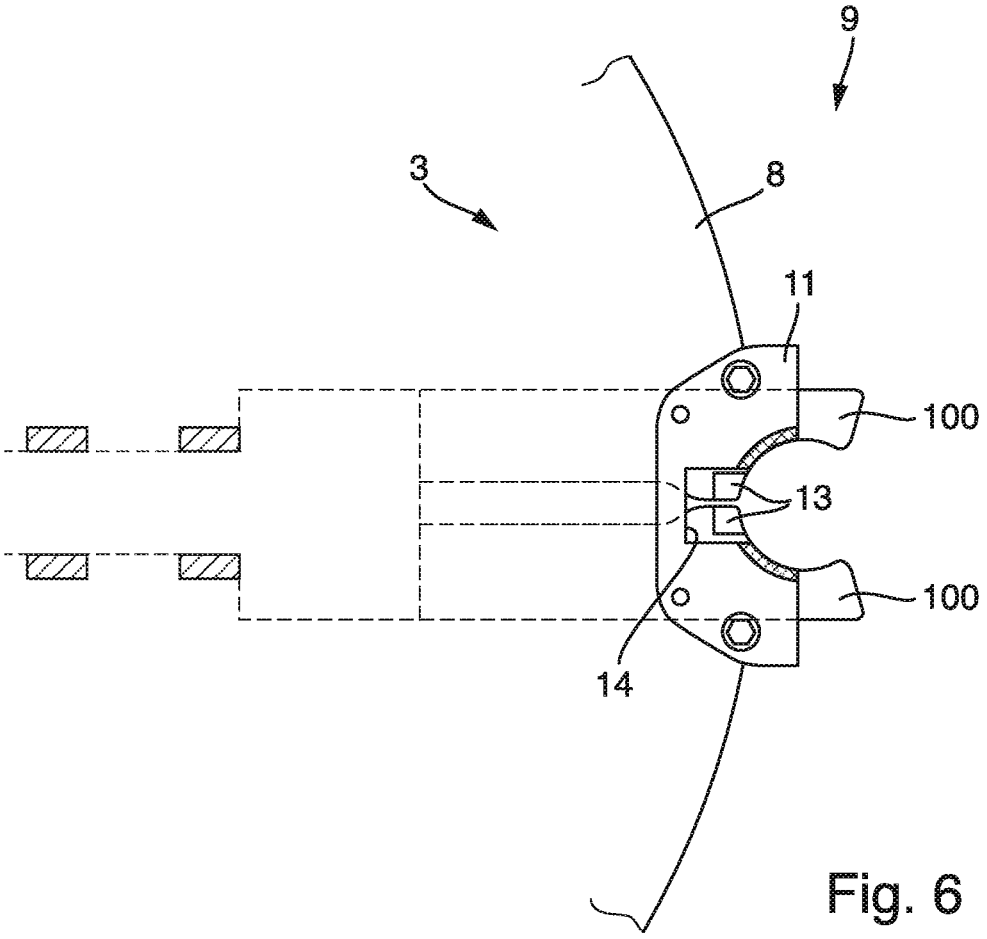
FIG. 6 is a schematic plan view of a portion of the beverage filling system according to FIG. 1, wherein the container transfer receptacle is in the radially retracted position.

FIG. 6 shows schematically a plan view of a portion of the beverage filling system 9 according to FIG. 2, wherein the container transfer receptacle 10 is in the treatment position, i.e. in the radially retracted position. Here the holding area of the container transfer receptacle 10 and the holding area of the container holder 11 are aligned with each other. By means of a recess 14 provided on the container holder 11, it is achieved that the container transfer receptacle 10 can be displaced radially inwards to the radially retracted position, without the raised element 13 colliding with the container holder 11.

Figure 7:
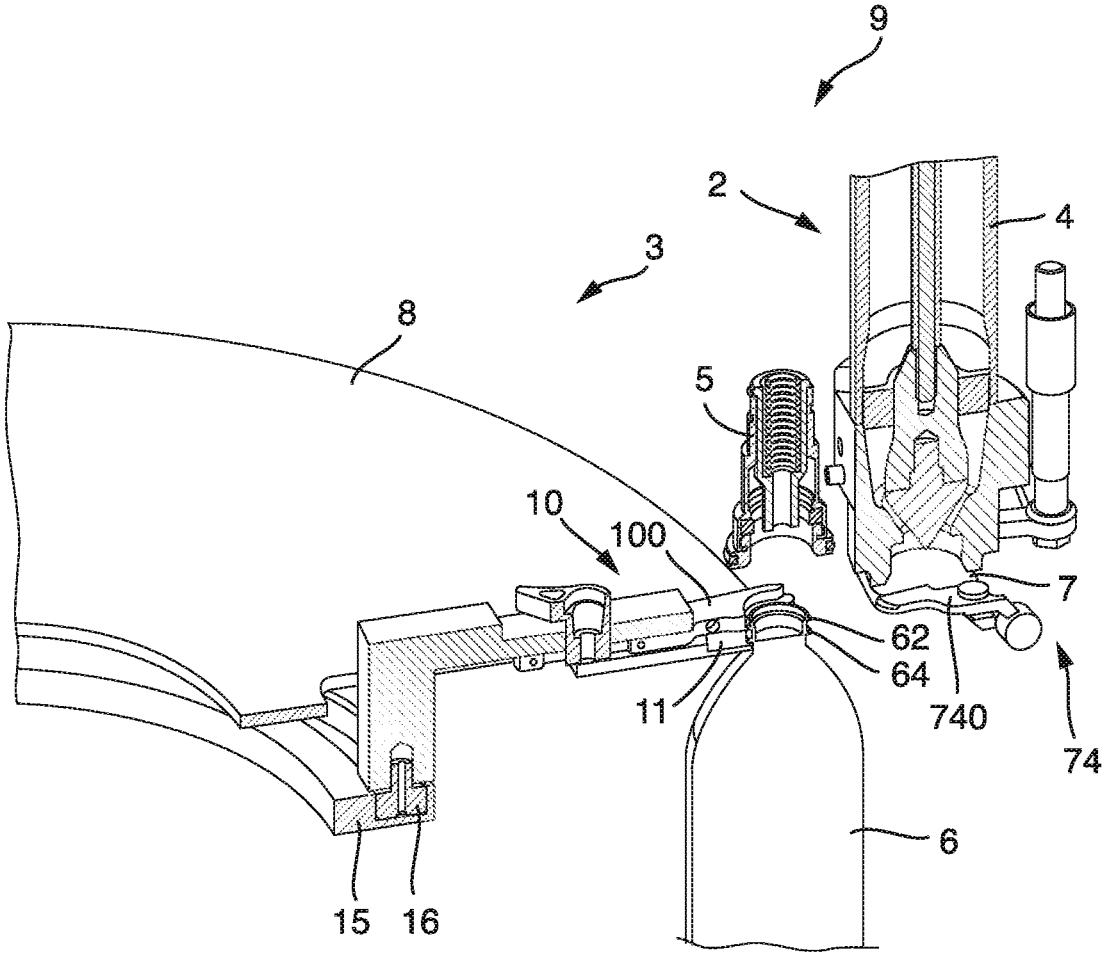
FIG. 7 is a schematic perspective sectional view of a detail of a further embodiment of a beverage filling system.

FIG. 7 shows schematically a perspective sectional view of a detail of a further embodiment of a beverage filling system 9, whose design corresponds substantially to that of the beverage filling system 9 from FIG. 1. In this example embodiment, the containers 6 that are to be treated have no container support ring 60. In this case, a security ring 64 formed on the container 6, behind which a tamper-evident band of the container closure engages when the container 6 is subsequently closed, is used as a protuberance for supporting the container on the container holder 11 and the container holder 74. The container holder 74 and the container holder 11 accordingly hold the container 6 in each case directly beneath the security ring 64, i.e. at the same point on the container 6.

In contrast to the device 1 from FIG. 1, in the embodiment shown in FIG. 7 the container transfer receptacle 10, which is here shown in the radially retracted position, is disposed above the container holder 11. The container transfer receptacle 10 additionally has two clamping arms 100 that are displaceable between an open position and a closed position, and whose position is controlled by the switching of a switching cam 18.

In FIG. 7, the clamping arms 100 are shown in the closed position. The clamping arms 100 are pivoted into the open position by actuation of the control cam by means of an actuating element (not shown) of the rotary capper 3, and the container 6 is thereby released, so that the container 6 is now held by the container holder 11 only. The capping head 5 can now be brought downwards onto the container 6, or its mouth area, in order to close the container 6 with a container closure. Because the clamping arms 100 have been pivoted outwards to the open position, there is no risk of a collision between them and either the capping head or the container closure that is to be applied or attached to the container 6.

In the embodiment shown in FIG. 7, the rotary filler 2 also has a switchable container holder 74. For this purpose, two holding arms 740 of the container holder 74 are pivotably disposed on the filler carousel 7. In order to hold the container 6, the holding arms 740 are switched from the open position that is shown in FIG. 7 to a closed position, by means of an actuating unit (not shown in the figure) that is provided on the rotary filler 2. The holding arms 740 then grip the container 6 by the container neck 62, beneath the security ring 64, so that the container 6 is supported on the holding arms 740 by means of the securing ring 64.

When the container 6 that is held in the container holder 74 of the filler carousel 7 is transferred to the container holder 11 of the capper carousel 8, the container transfer receptacle 10, which is in the open position, is displaced by the control guide 15 to the radially extended position, so that the container holder 74 and the container transfer receptacle 10 align with each other, as described above. On each side of the neck of the container 6 there is accordingly one clamping arm 100, so that the container 6 can be gripped from opposite sides by the holding arms. The container transfer receptacle 10 is then switched to the closed position by the switching of the switching cam 18, so that the clamping arms 100 of the container transfer receptacle 10 grip the container 6 above the security ring 64. Next the holding arms 740 of the container holder 74 are pivoted away from the container 6, such that the container holder 74 is in the open position. The container 6 is now held by the container transfer receptacle 10 alone. The container transfer receptacle 10 is then displaced into the radially retracted position, so that it is aligned with the container holder 11, wherein the container 6 is pressed into the container holder 11. The container transfer receptacle 10 is then switched to the open position, so that the clamping arms 100 disengage from the container 6, and the container 6 is held during the capping process by the container holder 11 alone. The transfer of the container 6 from the rotary filler 2 to the rotary capper 3 thus takes place in a direct manner, and without the interposition of a further, separate transfer starwheel.

Alternatively, the clamping arms 100 of the container transfer receptacle 10 can remain closed during the closing process, in order for example to provide an additional torque support. In this embodiment, the clamping arms 100 of the container transfer receptacle 10 are not opened until a later stage of the closing process, or after the closing process.

The container transfer receptacle 10 can also be used for the subsequent transfer of the containers 6, which have then been closed, to a downstream transport device, for example for the transfer of the closed containers 6 to a transport starwheel or a conveyor belt.

To the extent applicable, all individual features described in the example embodiments can be combined with each other and/or exchanged, without departing from the field of the invention.

The invention claimed is:

1. A device for treating at least one container, comprising:

a treatment carousel rotatable about an axis of rotation, comprising at least one treatment unit arranged in a peripheral region of the treatment carousel;

a first container holder arranged on the treatment carousel and associated with the at least one treatment unit, wherein the first container holder is configured to hold a container during treatment with the at least one treatment unit; and a container transfer receptacle associated with the first container holder and radially displaceable with respect to the axis of rotation, wherein:

when the container transfer receptacle is displaced in a radially extended position, there is an increase in a radius with which the container transfer receptacle rotates about the axis of rotation, the container transfer receptacle is configured to receive the container from an upstream treatment carousel and/or to transfer a treated container to a downstream treatment carousel, and the container transfer receptacle is disposed above the first container holder or below the first container holder, viewed in the direction of the axis of rotation.

2. The device of claim 1, wherein the container transfer receptacle is displaceable to the radially extended position to receive the container from the upstream treatment carousel, and is displaceable to a radially retracted position to transfer the container to the first container holder.

3. The device of claim 1, wherein the container transfer receptacle is displaceable from a radially retracted position to transfer the treated container from the first container holder to the container transfer receptacle, and is displaceable to the radially extended position to transfer the treated container to the downstream treatment carousel.

4. The device of claim 1, wherein the container transfer receptacle is configured to transfer a container held in the container transfer receptacle to the first container holder in a radially retracted position.

5. The device of claim 1, further comprising a second container holder of the upstream treatment carousel and/or the downstream treatment carousel, wherein first container holder is at the same level as the second container holder.

6. The device of claim 1, wherein the first container holder comprises a securing element configured to provide security against slipping when the container is held.

7. The device of claim 6, wherein the securing element comprises spikes, at least one indentation, and/or at least one friction-enhancing material.

8. The device of claim 1, wherein the container transfer receptacle comprises at least one raised element configured to at least partially support the container.

9. The device of claim 8, wherein the first container holder comprises a recess configured to accommodate the at least one raised element.

10. The device of claim 1, further comprising a non-rotatable control guide configured to control the radial position of the container transfer receptacle when the treatment carousel rotates.

11. The device of claim 10, wherein the non-rotatable control guide comprises a cam curve, and the container transfer receptacle comprises a control element that is engaged with the non-rotatable control guide.

12. The device of claim 1, wherein the container transfer receptacle is displaceable in the direction of the axis of rotation.

13. The device of claim 1, wherein the container transfer receptacle and/or the first container holder is switchable between an open position to receive or take the container and a closed position to hold the container.

14. The device of claim 1, wherein the treatment unit comprises a capping head configured to close a filled container and/or comprises a filling element configured to fill a container.

15. A beverage filling system for filling containers with a filling product, comprising:

a filler carousel configured to fill the containers, wherein the filler carousel comprises a filling element and a first container holder in a peripheral region of the filler carousel;

a capper carousel configured to close filled containers, wherein the capper carousel comprises a closing element and a second container holder in a peripheral region of the capper carousel; and a container transfer receptacle disposed in the peripheral region of the filler carousel and/or the capper carousel and configured to receive a filled container from the filler carousel and/or to transfer the filled container to the capper carousel, wherein:

the container transfer receptacle is associated with each container holder and is disposed such that the container transfer receptacle is radially displaceable with respect to an axis of rotation of the capper carousel, when the container transfer receptacle is displaced in a radially extended position, there is an increase in a radius with which the container transfer receptacle rotates about the axis of rotation, and the container transfer receptacle is disposed above the first container holder or below the first container holder, viewed in the direction of the axis of rotation, and wherein the filler carousel and the capper carousel are spaced apart from each other.

16. The beverage filling system of claim 15, wherein the first container holder and the second container holder are disposed at the same height.

17. The beverage filling system of claim 15, further comprising a protuberance disposed on a container neck of a container and configured to support the container on the first container holder and the second container holder.

18. The beverage filling system of claim 17, wherein the protuberance comprises a container support ring or a security ring.

19. The beverage filling system of claim 15, wherein the first container holder and the second container holder and/or the container transfer receptacle is switchable between an open position and a closed position.

* * * * *